United States Patent [19]

Lang

[11] Patent Number: 4,583,329

[45] Date of Patent: Apr. 22, 1986

[54] HIGH PRESSURE JETS

[75] Inventor: Howard J. Lang, Swindon, England

[73] Assignee: Water Research Centre, Swindon, England

[21] Appl. No.: 699,199

[22] Filed: Feb. 7, 1985

[30] Foreign Application Priority Data

Feb. 9, 1984 [GB] United Kingdom ..... 8403428
Aug. 10, 1984 [GB] United Kingdom ..... 8420429

[51] Int. Cl.[4] ..... B24C 7/00

[52] U.S. Cl. ..... 51/410; 51/436; 51/321; 51/319

[58] Field of Search ..... 51/410, 411, 436, 319, 51/321

[56] References Cited

U.S. PATENT DOCUMENTS 2,108,545 11/1938 Minich ..... 51/436
3,109,262 11/1963 Weaver ..... 51/411
3,994,097 11/1976 Lamb ..... 51/321
4,057,940 11/1977 Wemmer .
4,233,785 11/1980 Abell ..... 51/436
4,330,968 5/1982 Kobayashi et al. .
4,548,001 10/1985 Link ..... 51/410

FOREIGN PATENT DOCUMENTS 834878 5/1960 United Kingdom .

*Primary Examiner*—Harold D. Whitehead
*Attorney, Agent, or Firm*—Watson, Cole, Grindle & Watson

[57] ABSTRACT

High pressure liquid jets including finely divided abrasive particles suspended therein, are produced a substantial distance (e.g. from 20 m up to 100 m or more) from the liquid and particle sources by separately pumping the liquid and the particles over the distance, and then combining the two in a venturi and delivering the mixture to a nozzle. The abrasive particles are conveyed over the distance in a carrier fluid (e.g. air) which is then separated off immediately before the particles arrive at the venturi.

10 Claims, 6 Drawing Figures

HIGH PRESSURE JETS

This invention is concerned with a method and apparatus for providing a high pressure jet comprising liquid and solid abrasive particles at a distance from the liquid and solid sources.

It is known to use a high pressure jet of liquid for cutting purposes and it is also known to mix abrasive particles in the liquid to improve the cutting performance of the jet. It has recently been proposed to use high pressure liquid jets in pipes such as sewers to clean away debris and to remove obstructions such as intruding ends of branch pipes. The technique is currently of particular interest in connection with the renovation of sewers by the insertion therein of plastics linings, it being necessary to cut branch openings in the linings in situ in the sewer. It has been proposed to introduce a remote-controlled device into the linings in the sewer, the device being arranged to cut away unwanted portions of the lining by use of a high pressure cutting fluid.

Such remote-controlled devices have to operate at considerable distances from the cutting fluid source(s), e.g. at distances of 20 meters up to 100 meters or more, and problems have arisen in providing an adequate supply of abrasive-containing fluids over such distances.

We have now devised improved ways in which this can be done. Whilst the method and apparatus of the invention will hereafter be described with particular reference to their use in remote cutting of pipelines, it is to be understood that they can equally be used for other purposes in which a high pressure fluid jet is utilised.

In accordance with the present invention, there is provided a method of providing a high pressure jet, comprising a liquid and finely divided solid abrasive particles mixed therein, whereby said jet may be produced at a substantial distance from sources of said liquid and said abrasive respectively, which method comprises delivering said liquid from a source thereof over said distance under pressure to a venturi; supplying, independently of said liquid, said abrasive from a source thereof over said distance, in a carrier fluid; separating carrier fluid from said delivered abrasive and feeding said abrasive to said venturi; and feeding the mixture of said liquid and said abrasive particles formed in the venturi to a nozzle to issue therefrom as a high pressure jet.

The invention also includes apparatus for providing a high pressure jet, comprising a liquid having finely divided solid abrasive particles dispersed therein, at a substantial distance from sources of said liquid and said abrasive respectively, which apparatus comprises a first conduit for delivering liquid from said pump over said distance from said source to a venturi; a second conduit, for delivering said abrasive in a carrier fluid over said distance to a separator for separating carrier fluid from said abrasive; a third conduit for delivering said abrasive from said separator to said venturi; and means for supplying the mixture of liquid and abrasive formed in the venturi to a nozzle for producing said high pressure jet.

In the method and apparatus of the invention, the liquid (such as water) and the abrasive are separately pumped over substantially the distance from their source to where the jet is required. Then they are mixed, preferably immediately upstream of the nozzle forming the jet, in a venturi device in which the high pressure liquid constitutes the primary flow. This primary flow induces a low pressure region downstream of the venturi constriction, into which the abrasive is drawn to mix with the liquid.

The abrasive particles are pumped over the distance from their source to the venturi principally suspended in a carrier fluid, i.e. in a fluidised state. (This state can be produced by pumping the carrier fluid through a venturi or the like into which the abrasive particles are fed.)

Preferably, just upstream of the main venturi, where the abrasive and liquid are mixed, a separator is provided to remove all or most of the carrier fluid (without any significant loss of solids particles). In its simplest form, the separator can be constituted by an orifice in the conduit whereby the carrier fluid e.g. air is vented off whilst the solids continue to pass along the conduit to the outer part of the main venturi. The orifice may include a solids deflecting device to prevent or reduce any tendency for solids to exit with the carrier fluid, but this is not usually necessary.

In the description of this invention, we have referred to the provision of a jet at a distance from the sources of liquid and abrasive. It is to be understood that what is important is the distance travelled by the liquid and abrasive between their respective sources and the main venturi. In practice, there will be substantial lengths of conduit involved but (where the conduit is flexible, as it almost always will be), the resulting high pressure jet can actually be adjacent one or other of the sources. The use of long lengths of conduit, however, enables the jet to be produced at substantial distances from the sources, which is an extremely important and useful facility.

The method and apparatus of the invention are particularly suited for use with devices such as that described in U.K. patent specification No. 2098300A to which reference should be made for further details. Such devices normally comprise a body supported on skids or the like so that it can be moved along inside a pipe. The body has one or more nozzles mounted thereon, and one or more motors for controlling movement of the nozzles. Closed circuit television may be provided to monitor the position of the device in the pipe and the cutting operation. In accordance with the present invention, the body may also include or support the venturi where the liquid and abrasive are mixed.

In order that the invention may be more fully understood, an embodiment thereof is illustrated, by way of example only, in the accompanying drawings, in which.

Figure 1:
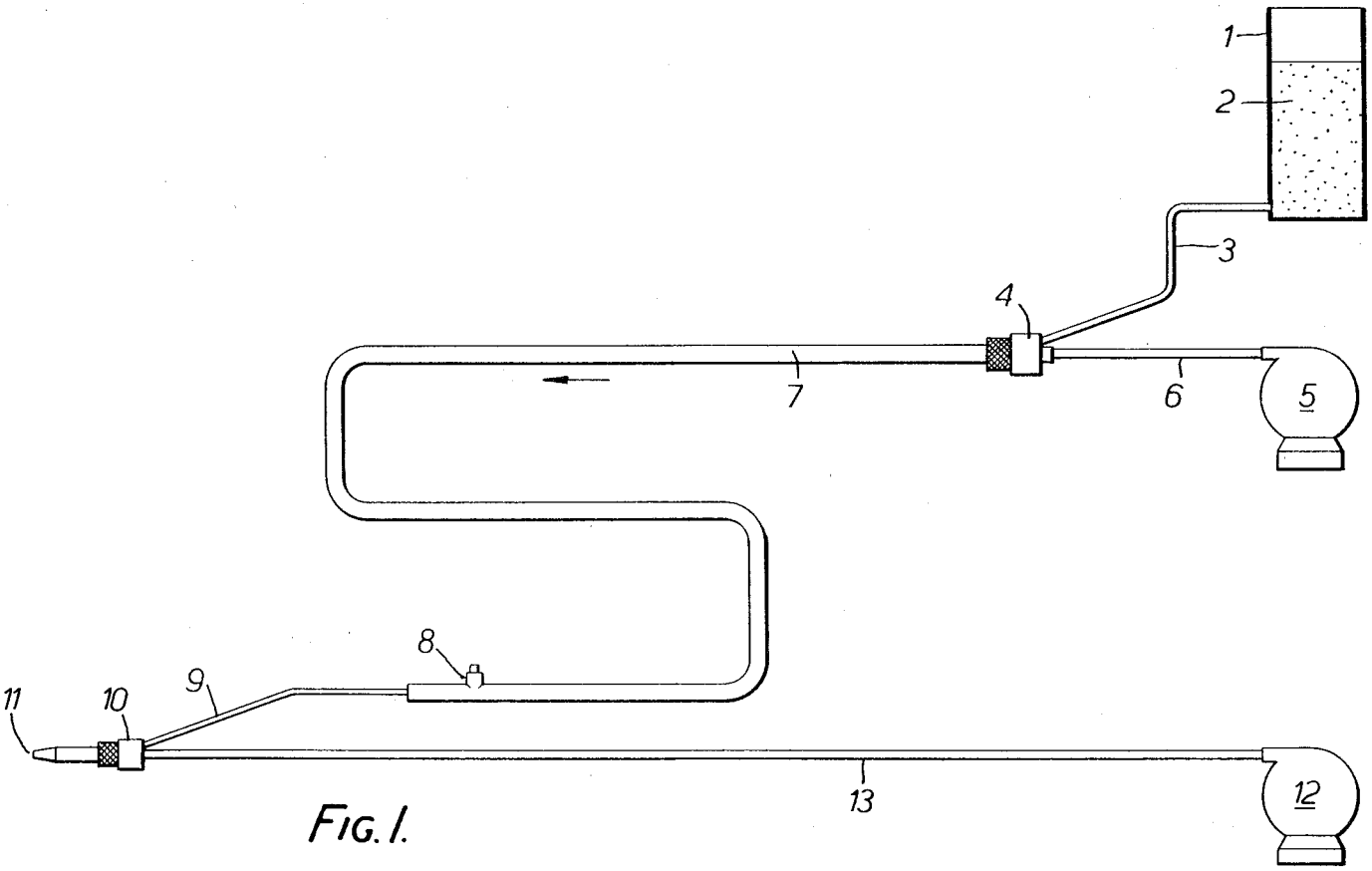
FIG. 1 is a schematic diagram of an embodiment of apparatus for forming a high pressure jet of water and finely divided solid abrasive.

Referring to FIG. 1, the apparatus comprises a reservoir or storage vessel 1 for finely divided abrasive material 2. Leading from vessel 1 is a supply conduit 3 communicating with a venturi 4 to which is pumped (from pump 5) a carrier fluid such as air. The air is supplied to venturi 4 along line 6, and forms the primary flow through the venturi, so that, in use, the abrasive material is drawn into fluidised admixture with the air at the downstream side of the venturi 4.

Connected to the downstream side of venturi 4 is elongate conduit 7, of a length sufficient in use to extend from the region of source vessel 1 to the region where the high pressure jet is required. At the downstream end of conduit 7 is a carrier fluid separator 8 and, immediately thereafter, a narrower bore conduit 9. Conduit 9 leads to a venturi 10 which is directly coupled, preferably as closely as possible, to a nozzle 11.

A pump 12 is connected to a liquid supply (not shown) to pump liquid under pressure along a conduit 13 to venturi 10. Conduit 13 is of a length sufficient in use to extend to the region where the high pressure jet is required. The liquid supply to venturi 10 is the primary fluid so that, in use, the abrasive in line 9 is drawn into admixture with the liquid and passes to the nozzle 11.

In use, pumps 5 and 12 are energised. Abrasive particles are fluidised in venturi 4 and travel along conduit 7. At separator 8 the air (or other carrier fluid) is separated and the particles travel along line 9 to mix with the liquid in venturi 10. The mixture is emitted as a high pressure jet from nozzle 11.

Separator 8 assists in keeping both venturis (4 and 10) functional. Venting off the carrier fluid (or most of it) reduces the line back pressure which is detrimental to achieving the venturi effect at nozzle 11.

The water pump 12 will normally be capable of operating at pressures in excess of 100 psi (0.69 MPa), eg at 1000 psi (6.9 MPa) and higher.

The lengths of conduits 7 and 13 can be considerable, eg. up to 100 meters or more.

Figure 2:
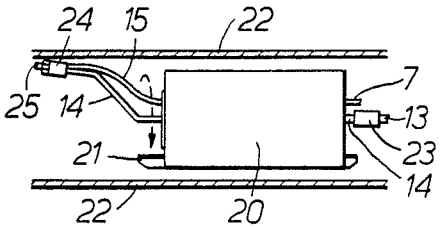
FIGS. 2 and 3 are side and end views of a cutting device in a pipe.
Figure 3:
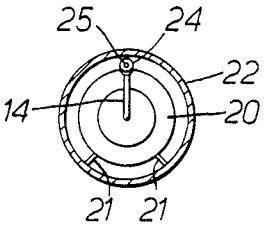

The apparatus of the invention (in use) provides a high pressure jet comprising abrasive particles in a liquid. The jet can be used for cutting and/or cleaning purposes, or for other purposes as desired. One important use is for operations within pipelines such as sewers, and for such uses it is usual to mount the nozzle 11 and venturi 10 on a device to enable them to be used at a remote location inside a pipe. One such device is illustrated in FIGS. 2 and 3. It comprises a body 20 on skids 21 for sliding in the pipe 22.

At the rear end of body 20 is a rotating coupling 23 for joining high pressure water conduit 13 to a pipe 14 extending axially through body 20. Pipe 14 extends forwardly of body 20 and is angled (as shown) and is connected into venturi 24 which delivers to nozzle 25. Abrasive supply line 7 likewise is coupled to a pipe 15 in body 20 (the coupling is not shown) and pipe 15 also extends forwardly of body 20 to venturi 24. Pipes 14 and 15 are so mounted as to be rotatable with venturi 24 and nozzle 25.

Figure 4:
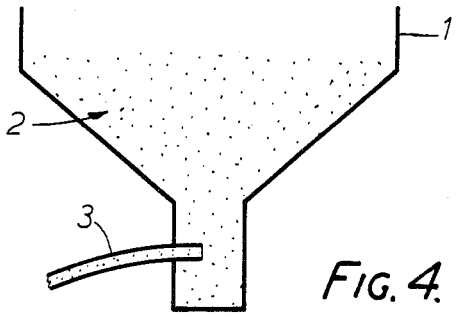
FIG. 4 is a section through the lower end portion of an abrasive hopper of the apparatus.

FIG. 4 shows the bottom of abrasive storage vessel 1, in this instance of hopper-like shape. Conduit 3 extends into the vessel in a position and attitude such that the abrasive will not fall into the conduit under gravity. Thus, when venturi 4 is not in operation, there will be zero abrasive flow in conduit 3. It is thus preferred for conduit 3 to extend generally horizontally into hopper 1, through the wall thereof adjacent the bottom end.

Figure 5A:
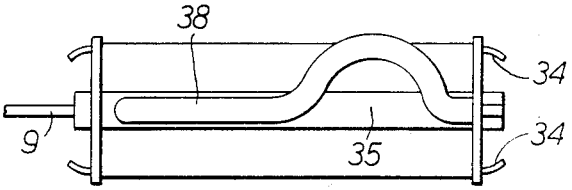
FIGS. 5A and 5B show, respectively, plan and side elevations of a preferred form of air/abrasive separator unit of the apparatus.
Figure 5B:
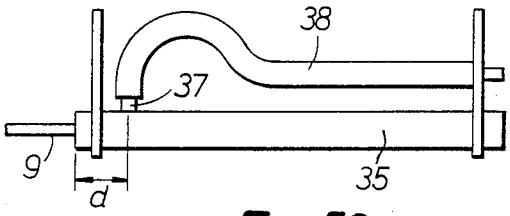

FIG. 5 shows the separator 8 of FIG. 1. This separator unit is mounted on skids 34 and includes a longitudinal pipe 35 for the air/abrasive flow (for which pipe 35 is either part of conduit 7 or is joined thereto). At the outlet end of pipe 35, there is an effective constriction at its connection with a smaller-diameter tube 9 leading to the venturi 10. An air vent hole 37 is formed in pipe 35 and its distance d from the constriction, or connection to tube 9, is kept to a minimum to prevent abrasive laying dormant within the pipe 35. The vent hole 37 connects to a hose 38 which is configured so as to prevent any water from passing back into the dry air/abrasive flow pipe 9, no matter what orientation about its axis the unit may adopt. Thus the hose is formed into two successive U-bends, one in the vertical plane and the other in the horizontal plane, the outlet end of the hose being directed rearwardly at the rear end of the separator unit.

I claim:

1. A method of providing a high pressure jet comprising a liquid and finely divided solid abrasive particles intimately mixed therein, said method enabling said jet to be produced at a substantial distance from sources of said liquid and said abrasive respectively, which method comprises: delivering said liquid under pressure from a source thereof over said distance to a first venturi; delivering a carrier gas under pressure to a second venturi to draw into carrying admixture therewith particulate abrasive from a source thereof; allowing the admixture to flow through a conduit over said distance; then venting carrier gas from the flowing admixture while the remaining particulate abrasive is drawn on into said first venturi to form therein a mixture with said liquid; and supplying the said mixture to a nozzle to issue therefrom as a high pressure jet of liquid and abrasive particles.

2. A method according to claim 1, wherein the carrier gas is separated from said abrasive particles in a separator comprising a through conduit having an orifice in a wall thereof for escape of said gas without significant concomitant loss of said abrasive particles.

3. A method according to claim 2, wherein said separator includes a vent hose connecting to said orifice exteriorly of said conduit, to vent said gas away from said orifice.

4. A method according to claim 2, wherein said separator includes a vent hose connecting to said orifice exteriorly of said conduit, said hose being so configured as substantially to prevent any liquid gathering therein from returning through said orifice into said conduit.

5. A method according to claim 1, wherein said liquid is aqueous, said carrier gas is air, and said high pressure jet is produced from a nozzle disposed within a pipe, such as a sewer.

6. A method according to claim 1, wherein said distance is at least 20 meters.

7. Apparatus for providing a high pressure jet, comprising a liquid having finely divided solid abrasive particles dispersed therein, at a substantial distance from sources of said liquid and said abrasive respectively, which apparatus comprises a first venturi, a first conduit for delivering liquid under pressure over said distance from said source to said first venturi; a second venturi means for delivering gas under pressure to said second venturi; a source of particulate abrasive; means connecting said source to said second venturi to allow said abrasive to be drawin into admixture with said gas therein; a separator for separating solids from the carrier gas; a second conduit, for delivering said abrasive in said carrier gas over said distance from said second venturi to said separator; a third conduit for delivering said abrasive from said separator to said first venturi; a nozzle for producing a high pressure jet; and means for supplying the mixture of liquid and abrasive formed in the venturi to said nozzle.

8. Apparatus according to claim 7, wherein said separator comprises a walled through-passage having an orifice in said wall, the orifice being so dimensioned and positioned as to permit carrier gas to exit therethrough without substantial concomitant loss of abrasive particles from said passage.

9. Apparatus according to claim 7, wherein said separator includes a walled through-passage having an orifice in a wall thereof to remove carrier gas, and wherein a vent hose is provided, externally of said through-passage, connecting to said orifice to vent way carrier gas.

10. Apparatus according to claim 9, wherein said vent hose is so configured as substantially to prevent any liquid exiting from said orifice to return therethrough into said through-passage.

* * * * *